US009528803B1

(12) United States Patent
Kim et al.

(10) Patent No.: US 9,528,803 B1
(45) Date of Patent: Dec. 27, 2016

(54) INCENDIARY GRENADE

(71) Applicants: Steven Kim, Crofton, MD (US); Conan Schultz, Waldorf, MD (US); Carl Gotzmer, Accokeek, MD (US)

(72) Inventors: Steven Kim, Crofton, MD (US); Conan Schultz, Waldorf, MD (US); Carl Gotzmer, Accokeek, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 805 days.

(21) Appl. No.: 13/987,619

(22) Filed: Aug. 15, 2013

(51) Int. Cl.
*F42B 12/44* (2006.01)
*F42B 12/46* (2006.01)
*F42B 4/26* (2006.01)
*F42B 27/00* (2006.01)

(52) U.S. Cl.
CPC ..... *F42B 12/44* (2013.01); *F42B 4/26* (2013.01); *F42B 12/46* (2013.01); *F42B 27/00* (2013.01)

(58) Field of Classification Search
CPC ..... F42B 4/26; F42B 12/36; F42B 12/44; F42B 12/46; F42B 12/50; F42B 27/00; F42B 27/08
USPC ..... 102/364
See application file for complete search history.

(56) References Cited

U.S. PATENT DOCUMENTS 3,731,632 A 5/1973 Stevens
4,112,846 A 9/1978 Gilbert et al.
4,318,343 A * 3/1982 King ..... F42B 12/44 102/365
4,331,080 A 5/1982 West et al.
5,372,069 A 12/1994 Hart et al.
5,698,812 A * 12/1997 Song ..... F42B 12/44 102/283
6,308,607 B1 * 10/2001 Woodall ..... B64D 1/04 102/402
6,766,744 B1 7/2004 Song et al.
6,945,175 B1 9/2005 Gotzmet et al.
7,568,432 B1 * 8/2009 Baker ..... C06B 33/06 102/364
8,118,955 B2 * 2/2012 Zavitsanos ..... C06B 27/00 102/287
8,485,099 B2 * 7/2013 Skidmore ..... F42B 12/44 102/364
8,857,342 B2 * 10/2014 Wilson ..... F42B 12/06 102/364

* cited by examiner

*Primary Examiner* — James S Bergin
(74) *Attorney, Agent, or Firm* — Fredric J. Zimmerman

(57) ABSTRACT

An incendiary grenade's casing has a fuze with a portion extending into the casing. Thermite disposed in the casing encases the portion of the fuze that extends into the grenade casing. Insulating material is disposed in the casing adjacent to the thermite. Layers of a titanium-boron intermetallic and an oxidizer are disposed in the casing. One layer of the titanium-boron intermetallic is adjacent to the layer of insulating material. This one layer of the titanium-boron intermetallic and a layer of the oxidizer adjacent thereto have a common-axis hole formed therethrough that is aligned with the portion of the fuze. A separating material is disposed at each interface between the titanium-boron intermetallic and the oxidizer.

22 Claims, 3 Drawing Sheets

INCENDIARY GRENADE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to grenades, and more particularly to an incendiary grenade.

BACKGROUND OF THE INVENTION

Incendiary grenades are used to generate thermal energy that is useful in the destruction of biological agents and certain types of hardware. Typically, incendiary grenades contain a thermite (e.g., aluminum/iron oxide) that, when ignited, generates flame temperatures of 4000-5000° F. for a few seconds. However, this burn temperature and burn duration may not be sufficient for some applications.

SUMMARY OF THE INVENTION

Accordingly, it is an object of the present invention to provide an incendiary grenade.

Another object of the present invention is to provide incendiary grenade having improved burn temperature and burn duration capabilities.

Still another object of the present invention is to provide incendiary grenade that is safe to handle and store.

Other objects and advantages of the present invention will become more obvious hereinafter in the specification and drawings.

In accordance with the present invention, an incendiary grenade includes a casing having a fuze with a portion thereof extending into the casing. A layer of thermite disposed in the casing encases the portion of the fuze that extends into the grenade casing. A layer of insulating material is disposed in the casing adjacent to the layer of thermite. Layers of a titanium-boron intermetallic and an oxidizer are disposed in the casing. One layer of the titanium-boron intermetallic is adjacent to the layer of insulating material. This one layer of the titanium-boron intermetallic and a separate layer of the oxidizer adjacent thereto have a common-axis hole formed therethrough. A separating material is disposed at each interface between the titanium-boron intermetallic and the oxidizer. A portion of the separating material extends perpendicular from each of the interfaces between the titanium-boron and the oxidizer along a length of the common-axis hole.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
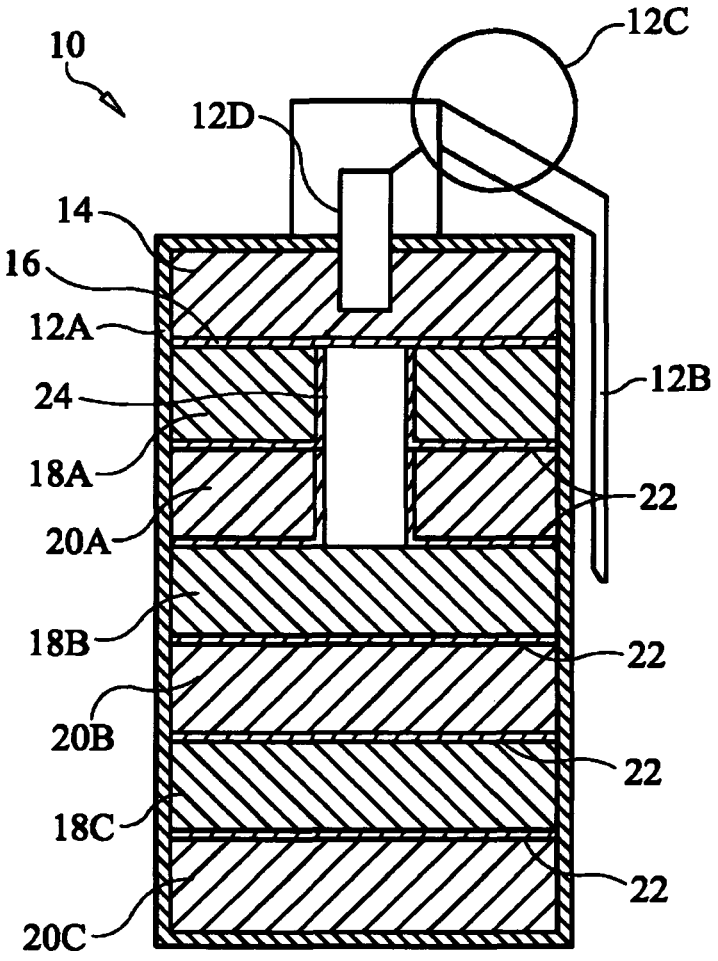
FIG. 1 is a schematic cross-sectional view of an incendiary grenade in accordance with an embodiment of the present invention.

Referring now to the drawings and more particularly to FIG. 1, a cross-sectional view of an incendiary grenade in accordance with an exemplary embodiment of the present invention is shown and is referenced generally by numeral 10. The novel aspects of grenade 10 reside within the grenade's casing. Accordingly, it is to be understood that the particular casing and casing components such as the grenade's handle, pin, etc., are not limitations of the present invention. By way of an illustrative example, grenade 10 may be structurally based on the casing and casing components of the U.S. military's AN-M14 thermite grenade.

The casing and casing components of grenade 10 are referenced by the base numeral 12. Briefly, the grenade's outer casing is referenced by numeral 12A, the grenade's handle is referenced by numeral 12B, the grenade's pin is referenced by numeral 12C, and the grenade's fuze is referenced by numeral 12D. Fuze 12D (e.g., the U.S. military's M201A1 fuze) extends partially into casing 12A. The function and operation of pin 12C, handle 12B, and fuze 12D are well understood in the art and will not be explained further herein.

A starter material 14 encases the portion of fuze 12D that extends into casing 12A. For example, starter material 14 may include a layer thereof (as shown) filling the upper regions of casing 12A. Starter material 14 is any acceptable material that initiates a burn reaction when fuze 12D is activated/ignited. Generally, starter material 14 is a thermite such as aluminum/iron oxide.

Adjacent the starter material 14 is a layer of insulating material 16. Insulating material 16 may be any material that resists burning when starter material 14 is ignited. In this way, the burn reaction of ignited starter material 14 eventually burns through the insulating material 16. Suitable materials for insulating material 16 may include plastic, wool, and cardboard.

Filling the remainder of casing 12A is at least one layer of a titanium-boron intermetallic and at least one layer of an oxidizer. In the exemplary embodiment illustrated in FIG. 1, three layers 18A, 18B and 18C of a titanium-boron intermetallic are alternated with three layers of an oxidizer 20A, 20B and 20C. Each intermetallic layer 18A/18B/18C is a titanium-boron intermetallic composition containing titanium, boron, and binder materials such as carboxyl-terminated butadiene and polytetra-fluoroethylene. The particular formulation may be adapted for a particular application as would be understood in the art. Further, it is to be understood that more or less alternating layers, that is, the number of alternating layers, of intermetallic and oxidizer material may be used without departing from the scope of the present invention. To prevent any migration between intermetallic layers 18A-C and oxidizer layers 20A-C, a separating material layer 22 (e.g., a plastic material or an insulating material) is disposed at each inter-metallic/oxidizer interface, that is, the separating material layer 22 is situated intermediate each of the intermetallic layers and the oxidizers layers, respectively.

Regardless of the number of intermetallic/oxidizer "sets" used in grenade 10 (e.g., layers 18A/20A form a first set, layers 18B/20B form a second set, etc.), an inter-metallic layer is always disposed adjacent insulating material 16. In this way, the initial reaction from ignited starter material 14 is first provided to the intermetallic (e.g., intermetallic layer 18A in the illustrated embodiment). As intermetallic layer 18A burns, the reaction byproduct, that is, titanium-diboride, is generated and provided to oxidizer layer 20A. A suitable oxidizer for use in the present invention is lithium perchlorate. However, it is to be understood that other oxidizers (e.g., sodium chlorate) could be used without departing from the scope of the present invention.

To expedite and enhance the burn attributes of grenade 10, a hole 24, that is, a common axis hole, which is aligned with the fuze 12D, may be provided in one or more of the intermetallic/oxidizer sets. More specifically, such a hole 24 is always provided in the first intermetallic/oxidizer set that is adjacent insulating material 16, and may be provided through additional sets as a means to control burn rate as will be explained later with respect to the embodiment illustrated in FIG. 2. In the FIG. 1 exemplary embodiment, the common-axis hole 24 is provided through layers 18A and 20A.

Figure 2:
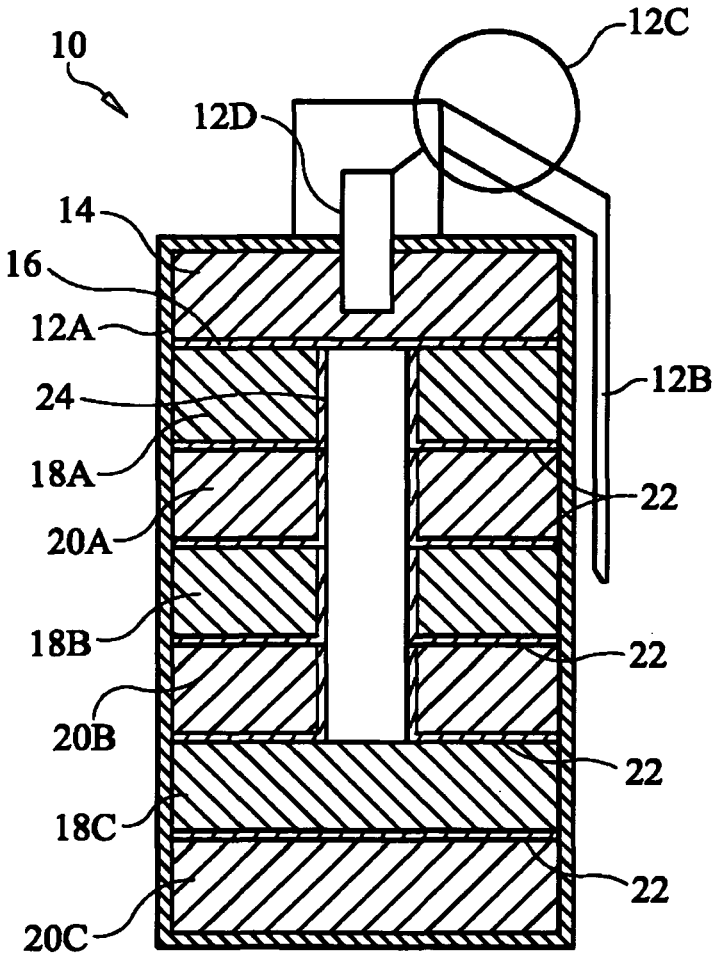
FIG. 2 is a schematic cross-sectional view of an incendiary grenade in accordance with another embodiment of the present invention.

Referring now to FIG. 2, another embodiment of the present invention is illustrated. In this embodiment, common-axis hole 24 is used as a means to increase the burn rate of the intermetallic/oxidizer sets. More specifically, hole 24 extends through two intermetallic/oxidizer sets (i.e., layers 18A/20A and 18B/20B). It is to be understood that hole 24 could also be extended through all intermetallic/oxidizer sets. In operation, the starting material 14 burns through the insulating layer 16 and the flame enters the common-axis hole 24 helping ignite the intermetallic/oxidizer sets.

Figure 3:
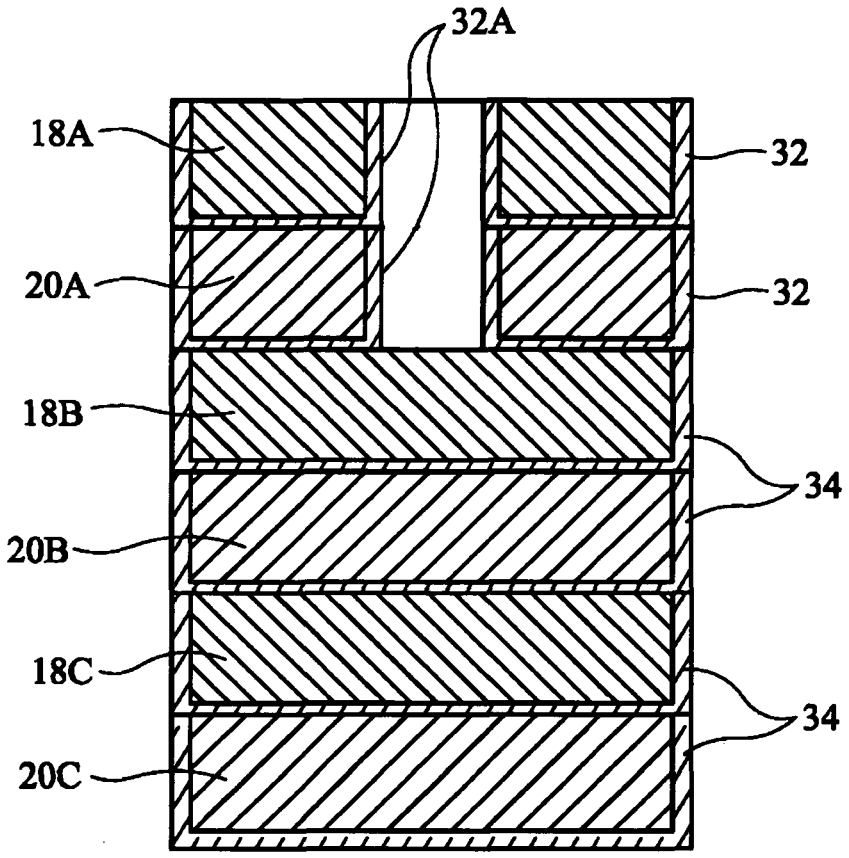
FIG. 3 is an isolated cross-sectional view of the alternating intermetallic layers and oxidizer layers for the embodiment illustrated in FIG. 1 where each layer has been pressed into a cup prior to placement in the grenade casing.

As mentioned above, separating material layers 22, e.g., an insulating material, are situated at each interface between each intermetallic layer 18A, 18*b*, 18C, and each oxidizer layer 20A, 20*b* and 20C. The separating material layers prevent migration between the intermetallic and oxidizer layers of the present invention. Layers 22 may be installed in casing 12A during the manufacturing process. Further, a portion of the separating material 22 extends perpendicular from each of the interface locations between each intermetallic layer 18A, 18*b* 18C, that is, the titanium-boron, and each oxidizer layer 20A, 20B, 20C, that is, the oxidizer, along a length of the common-axis hole 24. However, the present invention is not so limited. For example, each intermetallic layer and oxidizer layer may be pre-formed in a cup designed to be placed/fitted in casing 12A. For example, FIG. 3 presents an isolated view of the alternating layer structure used in FIG. 1 where intermetallic layer 18A and oxidizer layer 20A are each pressed into a donut-shaped cup 32 (e.g., a plastic cup) having a central hole 32A, while intermetallic layers 18B/18C and oxidizer layers 20B/20C are each pressed into a conventional cup 34. The pre-filled cups may be stacked in a grenade casing (not shown) with intermetallic/oxidizer interfaces being separated by the cups.

The advantages of the present invention are numerous. The layered titanium-boron intermetallic oxidizer construction provides high burn temperatures of approximately 7000° F. The layered construction and hole bored therethrough may be used to adjust the burn rate for a desired effect.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. An incendiary grenade, comprising:

a casing including a fuze with a portion thereof extending into said casing;

a layer of thermite being disposed in said casing and encasing said portion of said fuze;

a layer of insulating material being disposed in said casing adjacent said layer of thermite;

layers of a titanium-boron intermetallic and an oxidizer disposed in said casing, wherein one layer of said titanium-boron intermetallic is adjacent said layer of insulating material, and wherein said one layer of said titanium-boron intermetallic and a layer of said oxidizer adjacent to said one layer of said titanium-boron intermetallic includes a common-axis hole formed therethrough; and a separating material being disposed at each interface between said titanium-boron intermetallic and said oxidizer, wherein portions of the separating material extend perpendicular from at least a first interface of said each interface and a second interface of said each interface both along a length of said common-axis hole.

2. The incendiary grenade as in claim 1, wherein said thermite comprises an aluminum/iron oxide thermite.

3. The incendiary grenade as in claim 1, wherein said insulating material is selected from the group consisting of plastic, wool, and cardboard.

4. The incendiary grenade as in claim 1, wherein said oxidizer is selected from the group consisting of sodium chlorate and lithium perchlorate.

5. The incendiary grenade as in claim 1, wherein said common-axis hole extends through at least two layers of said titanium-boron intermetallic and at least two layers of said oxidizer.

6. The incendiary grenade as in claim 1, wherein said separating material is comprised of a plastic material.

7. The incendiary grenade as in claim 1, wherein said separating material is in a form of a cup filled with one of said titanium-boron intermetallic and said oxidizer.

8. The incendiary grenade as in claim 7, wherein said cup is a plastic cup.

9. An incendiary grenade, comprising:

a casing including a fuze with a portion thereof extending into said casing;

an aluminum/iron oxide thermite encasing said portion of said fuze;

an insulating material being disposed in said casing adjacent said aluminum/iron oxide thermite;

layers of a titanium-boron intermetallic and a lithium perchlorate oxidizer being disposed in said casing, wherein one layer of said titanium-boron inter-metallic is adjacent said insulating material, wherein said one layer of said titanium-boron intermetallic and a layer of said lithium perchlorate oxidizer adjacent to said one layer of said titanium-boron intermetallic include a common-axis hole formed therethrough, and wherein said common-axis hole is aligned with said portion of said fuze; and a separating material being disposed at each interface between said titanium-boron intermetallic and said lithium perchlorate oxidizer, wherein portions of the separating material extend perpendicular from at least a first interface of said each interface and a second interface of said each interface, which is between said titanium-boron and said oxidizer, along a length of said common-axis hole.

10. The incendiary grenade as in claim 9, wherein said insulating material is selected from the group consisting of plastic, wool, and cardboard.

11. The incendiary grenade as in claim 9, wherein said common-axis hole extends through at least two layers of said titanium-boron intermetallic and at least two layers of said lithium perchlorate oxidizer.

12. The incendiary grenade as in claim 9, wherein said separating material is comprised of an insulating material.

13. The incendiary grenade as in claim 9, wherein said separating material is in a form of a cup filled with one of said titanium-boron intermetallic and said lithium perchlorate oxidizer.

14. The incendiary grenade as in claim 13, wherein said cup is a plastic cup.

15. An incendiary grenade, comprising:

a casing including a fuze with a portion thereof extending into said casing;

a thermite encasing said portion of said fuze;

an insulating material being disposed in said casing adjacent said thermite;

alternating layers of a titanium-boron intermetallic and an oxidizer being disposed in said casing, wherein a first layer of said titanium-boron intermetallic is adjacent said insulating material, wherein said first layer of said titanium-boron intermetallic and a first layer of said oxidizer adjacent to said first layer of said titanium-boron intermetallic includes a common-axis hole formed therethrough and aligned with said portion of said fuze; and a separating material being disposed at each interface between said titanium-boron intermetallic and said oxidizer, wherein portion of the separating material extends perpendicular from at least a first interface of said each interface and a second interface of said each interface, which is between said titanium-boron and said oxidizer, along a length of said common-axis hole.

16. The incendiary grenade as in claim 15, wherein said thermite comprises an aluminum/iron oxide thermite.

17. The incendiary grenade as in claim 15, wherein said insulating material is selected from the group consisting of plastic, wool, and cardboard.

18. The incendiary grenade as in claim 15, wherein said oxidizer is selected from the group consisting of sodium chlorate and lithium perchlorate.

19. The incendiary grenade as in claim 15, wherein said common-axis hole extends through at least two layers of said titanium-boron intermetallic and at least two layers of said oxidizer.

20. The incendiary grenade as in claim 15, wherein said separating material is an insulating material.

21. The incendiary grenade as in claim 15, wherein said separating material is in a form of a cup filled with one of said titanium-boron intermetallic and said oxidizer.

22. The incendiary grenade as in claim 21, wherein said cup is a plastic cup.

* * * * *